US005642763A

United States Patent [19]

Kurtz

[11] Patent Number: 5,642,763

[45] Date of Patent: Jul. 1, 1997

[54] LIQUID DRAINING DEVICE HAVING UPPER FUNNEL AND LOWER DRIP GUIDE FEATURES

[76] Inventor: Lloyd Kurtz, 610 N. Main, Ellinwood, Kans. 67526-1441

[21] Appl. No.: 524,393

[22] Filed: Sep. 6, 1995

[51] Int. Cl.[6] ..... B65B 1/04

[52] U.S. Cl. ..... 141/375; 141/319; 141/332; 141/384

[58] Field of Search ..... 141/18, 106, 311 R, 141/312, 319, 332, 346, 363, 364, 365, 366, 367, 375, 376, 378, 383, 384, 385, 386

[56] References Cited

U.S. PATENT DOCUMENTS

| | | | |
|---|---|---|---|
| 2,773,521 | 12/1956 | Persson | 141/364 |
| 3,028,032 | 4/1962 | Jones | 141/364 |
| 3,156,272 | 11/1964 | Indrunas | 141/319 |
| 3,266,533 | 8/1966 | McHale | 141/364 |
| 3,615,150 | 10/1971 | Indrunas | 141/375 |
| 3,620,267 | 11/1971 | Seablom | 141/364 |
| 3,945,617 | 3/1976 | Callery | 259/54 |
| 3,963,063 | 6/1976 | Pascarella | 141/309 |
| 4,313,477 | 2/1982 | Sebalos | 141/364 |
| 4,336,891 | 6/1982 | Smith | 141/364 |
| 4,347,879 | 9/1982 | Blaser | 141/364 |
| 4,454,897 | 6/1984 | Valiant | 141/364 |
| 5,472,025 | 12/1995 | Conrad et al. | 141/332 |

*Primary Examiner*—Henry J. Recla
*Assistant Examiner*—Steven O. Douglas
*Attorney, Agent, or Firm*—John R. Flanagan

[57] ABSTRACT

A liquid draining device includes a body having a central passageway extending therethrough, an interior funnel formed at the top end of the central passageway near the top end of the body and an interior drip guide formed at the bottom end of the central passageway near the bottom end of the body. The funnel is for receiving any remaining liquid from a first narrow neck container disposed in an inverted relation thereover. The drip guide is for discharging any liquid draining down from the funnel through the central passageway into a second narrow neck container disposed in an upright relation thereunder. The funnel is formed by a top annular surface on a middle portion of the body being concave in shape relative to a top end portion of the body for receiving a liquid draining from the open neck end of the first narrow neck container. The drip guide is formed by a bottom annular surface on the middle portion of the body being convex in shape relative to the top end portion of the body for discharging liquid draining from the funnel through the central passageway of the body into the open neck end of the second narrow neck container. The drip guide prevents liquid draining from the inverted first container from running between the connection of the device with the neck of the upright second container and creating an external mess.

11 Claims, 1 Drawing Sheet

LIQUID DRAINING DEVICE HAVING UPPER FUNNEL AND LOWER DRIP GUIDE FEATURES

BACKGROUND OF THE INVENTION

1. Field of the Invention present invention generally relates to liquid draining devices and, more particularly, is concerned with a device having an upper interior funnel and a lower interior drip guide for draining remaining liquid from a nearly empty narrow neck container to another like container.

2. Description of the Prior Art

Many containers which hold various types of liquids often have narrow necks leading to a single top opening. When these narrow neck containers are nearly empty, it is often difficult to completely drain the liquid from them so as to avoid waste or environmental contamination upon disposal of the container. One technique for removal of liquid from a nearly empty container is simply to invert the container upside down and to allow gravity to drain any remaining liquid into another upright container. A variety of devices have been proposed over the years for draining liquids from one container to another generally in the above mentioned fashion.

Representative examples of liquid draining devices are disclosed in U.S. Pat. No. 2,773,521 to Persson, U.S. Pat. No. 3,028,032 to Jones, U.S. Pat. No. 3,266,533 to McHale, U.S. Pat. No. 3,615,150 to Indrunas, U.S. Pat. No. 3,620,267 to Seablom, U.S. Pat. No. 3,945,617 to Callery, U.S. Pat. No. 3,963,063 to Pascarella, U.S. Pat. No. 4,313,477 to Sebalos, U.S. Pat. No. 4,347,879 to Blaser and U.S. Pat. No. 4,454,897 to Valiant. All of these prior art devices secure the inverted top open end of a nearly empty container over the upright top open end of another container so as to permit gravity to drain any remaining liquid from the nearly empty inverted container into the upright container.

A common element in many of these devices is a hollow body having an interior surface which is threaded or otherwise shaped at each of a pair of opposite open ends for receiving therein the threaded exterior surfaces of the narrow necks of the inverted and upright containers. A problem appears to exist, however, with these devices in that the liquid draining from the inverted container may run between the threads of the device and the narrow neck of the upright container and create an external mess.

Consequently, a need remains for a device by which any remaining liquid in one narrow neck container can be drained into another like container without creating the above mentioned external mess.

SUMMARY OF THE INVENTION

The present invention provides a liquid draining device designed to satisfy the aforementioned need in the prior art. The liquid draining device of the present invention has an upper interior funnel and a lower interior drip guide for draining remaining liquid from a nearly empty narrow neck container to another like container. The liquid draining device generally enables liquid to be drained from one container to another without the risk of creating an external mess.

Accordingly, the present invention is directed to a liquid draining device which comprises: (a) a body having a central passageway extending therethrough; (b) a funnel formed at the top end of the central passageway near the top end of the body; and (c) a drip guide formed at the bottom end of the central passageway near the bottom end of the body. The funnel is for receiving any remaining liquid from a first narrow neck container disposed in an inverted relation thereover. The drip guide is for discharging any liquid draining down from the funnel through the central passageway into a second narrow neck container disposed in an upright relation thereunder.

More particularly, the funnel is formed by a top annular surface on a middle portion of the body being substantially concave in shape relative to a top end portion of the body. The funnel extends inwardly and downwardly from a top end cavity of the top end portion of the body to an upper end section of the central passageway for receiving liquid draining from the open neck end of the first narrow neck container.

The drip guide is formed by a bottom annular surface on the middle portion of the body being substantially convex in shape relative to the top end portion of the body. The drip guide extends outwardly and upwardly from a lower end section of the central passageway to a bottom end cavity of a bottom end portion of the body for discharging liquid draining from the funnel through the central passageway of the body into the open neck end of the second narrow neck container. The drip guide prevents liquid draining from the inverted first container from running between the connection of the device and the neck of the upright second container and creating an external mess.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
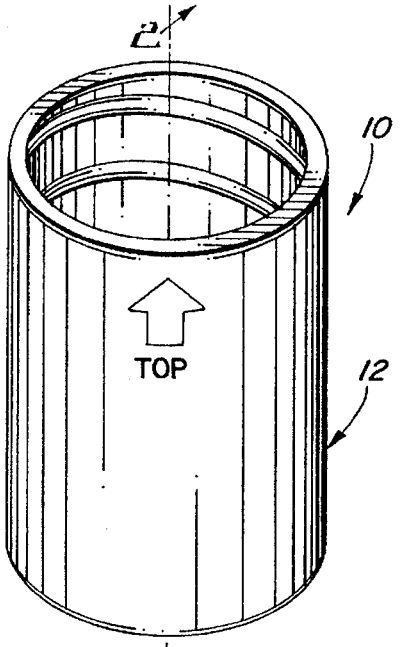
FIG. 1 is a side perspective view of the liquid draining device of the present invention.
Figure 3:
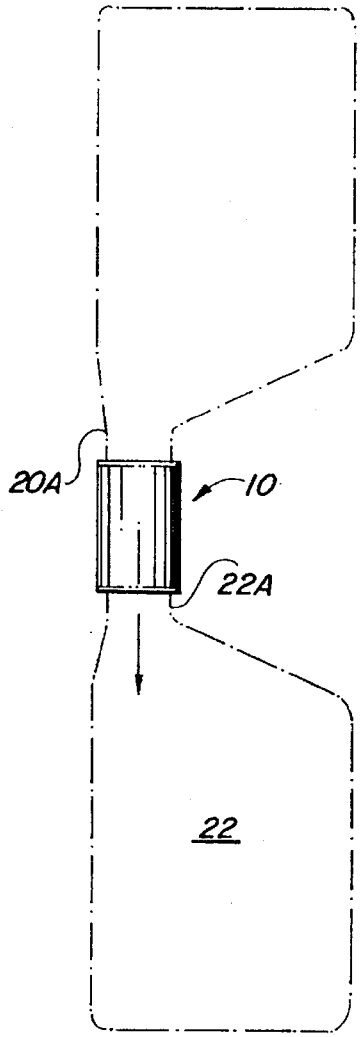
FIG. 3 is a side elevational view of the liquid draining device on a reduced scale employed between a pair of narrow neck containers shown in phantom.
Figure 2:
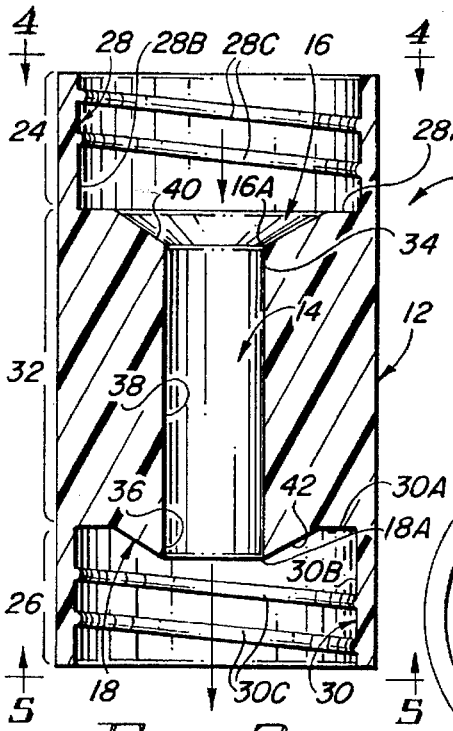
FIG. 2 is a longitudinal sectional view of the liquid draining device taken along line 2—2 of FIG. 1.
Figure 4:
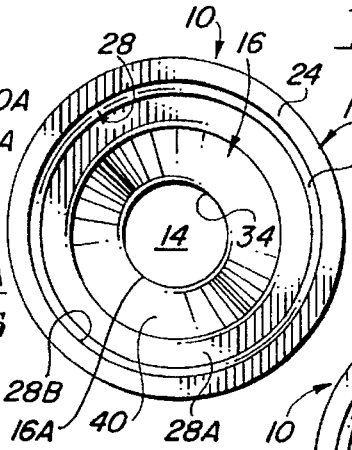
FIG. 4 is a top plan view of the liquid draining device as seen along line 4—4 of FIG. 2.
Figure 5:
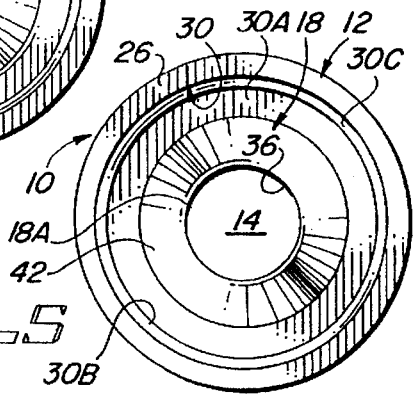
FIG. 5 is a bottom plan view of the liquid draining device as seen along line 5—5 of FIG. 2.

Referring to the drawings and particularly to FIGS. 1 to 3, there is illustrated a liquid draining device, generally designated 10, of the present invention for use between a pair of narrow neck containers. The device 10 basically includes a body 12 having a central passageway 14 extending therethrough, an upper interior funnel 16 formed at the top end of the central passageway 14 near the top end of the body 12 and a lower interior drip guide 18 formed at the bottom end of the central passageway 14 near the bottom end of the body 12. The upper funnel 16 at the top end of the central passageway 14 is for receiving any remaining liquid from a first narrow neck container 20 disposed in an inverted relation thereover. The lower drip guide 18 at the bottom end of the central passageway 14 is for discharging any liquid draining down from the upper funnel 16 through the central passageway 14 into a second narrow neck container 22 disposed in an upright relation thereunder.

Referring to FIG. 2, the body 12 has a pair of opposite top and bottom end portions 24, 26 defining a pair of opposite top and bottom end cavities 28, 30 therein adapted for receiving respective open neck ends 20A, 22A of the first and second narrow neck containers 20, 22, as shown in FIG. 3, and a middle portion 32 extending between and rigidly interconnecting the top and bottom end portions 24, 26. The middle portion 32 of the body 12 has opposite upper and lower faces thereon respectively forming an inner bottom surface 28A of the top end cavity 28 and an inner top surface 30A of the bottom end cavity 30. The inner bottom and top surfaces 28A, 30A are substantially flat and annular in configuration. Also, the flat annular inner top surface 30A is spaced below and extends substantially parallel to the flat annular inner bottom surface 28A. The central passageway 14 extends through the middle portion 32 between and open at the top and bottom end cavities 28, 30. The central passageway 14 has upper and lower opposite end sections 34, 36 and an intermediate section 38 extending between and merging integrally with the upper and lower end sections 34, 36. The body 12 is furthermore substantially cylindrical in shape and is preferably made of a substantially rigid material which can be any suitable material and preferably is a recycled plastic. The body 12 and central passageway 14 are both generally elongated relative to the end cavities 28, 30. As one example, the body 12 is 1 3/16 inches in diameter and 2 1/8 inches long. The body 12 can have a variety of different sizes depending upon the size of the open neck ends 20A, 22A of the first and second containers 20, 22.

The upper funnel 16 particularly is formed by a continuous uninterrupted top annular surface 40 on the middle portion 32 of the body 12 being substantially concave in shape relative to the top end portion 24 of the body 12. The upwardly concave top annular surface 40 forming the funnel 16 extends inwardly and downwardly from an the flat anhular inner bottom surface 28A of the top end cavity 28 in the top end portion 24 of the body 12 to the upper end section 34 of the central passageway 14 for receiving the liquid draining from the open neck end 20A of the first narrow neck container 20 disposed in the inverted relation directly thereabove. The presence of the downwardly concave funnel 16 spaces the bottom of the top end cavity 28 formed by the inner bottom surface 28A above the upper end section 34 of the central passageway 14.

The drip guide 18 particularly is formed by a continuous uninterrupted bottom annular surface 42 on the middle portion 32 of the body 12 being substantially convex in shape relative to the top end portion 24 of the body 12. The convex bottom annular surface 42 forming the drip guide 18 extends outwardly and upwardly from the lower end section 36 of the central passageway 14 to an the flat anhular inner top surface 30A of the bottom end cavity 30 in the bottom end portion 26 of the body 12 for discharging liquid draining from the funnel 16 through the central passageway 14 of the body 12 into the open neck end 22A of the second narrow neck container 22 disposed in the upright relation directly therebelow. The presence of the downwardly convex drip guide 18 spaces the top of the bottom end cavity 30 formed by the inner top surface 30A above the lower end section 36 of the central passageway 14.

The flat annular inner bottom surface 28A on the upper face of the middle portion 16 surrounds the top annular surface 40 thereon defining the downwardly concave upper funnel 16. The flat annular inner top surface 30A on the lower face of the middle portion 16 surrounds the bottom annular surface 42 thereon defining the downwardly convex lower drip guide 18. Furthermore, the top and bottom annular surfaces 40, 42 forming the upper funnel 16 and lower drip guide 18 intersect and form respective upper and lower annular sharp edges 16A, 18A with the upper and lower opposite end sections 34, 36 of the central passageway 14. The upper annular sharp edge 16A of the upper funnel 16 and the lower annular sharp edge 18A of the lower drip guide 18 are vertically spaced from one another at the opposite ends of the central passageway 14.

The concave shape and continuous uninterrupted configuration of the top annular surface 40 forming the upper funnel 16 causes liquid draining from the open neck end 20A of the first narrow neck container 20 disposed in an inverted relation directly above the inner bottom surface 28A of the top end cavity 28 to be received by the upper funnel 16 and drain from the upper annular sharp edge 16A of the upper funnel 16 at any location thereabout and into the upper end section of passageway 14. The convex shape and continuous uninterrupted configuration of the bottom annular surface 42 forming the lower drip guide 18 causes liquid draining downward through the passageway 14 to discharge from the lower annular sharp edge 18A of the lower drip guide 18 at any location thereabout into the open neck end 22A of the second narrow neck container 22 disposed in an upright relation directly below the inner top surface 30A of the bottom end cavity 30.

Referring now to FIGS. 1 to 5, the top and bottom end cavities 28, 30 of the top and bottom end portions 24, 26 of the body 12 are each substantially cylindrical in shape and each have a substantially similar diameter relative to one another. The top and bottom end cavities 28, 30 preferably have continuous sidewall surfaces 28B, 30B with internal threads 28C, 30C formed thereon for receiving respective external threads on the open neck ends 20A, 22A of the narrow neck containers 20, 22 for securely connecting the device 10 to the containers 20, 22. The top and bottom end cavities 28, 30 each has a slightly larger diameter relative to that of the open neck ends 20A, 22A of the narrow neck containers 20, 22 for receiving the open neck ends 20A, 22A therein. The central passageway 14 is further substantially cylindrical in shape and has a diameter substantially smaller relative to that of the top and bottom end cavities 28, 30. The top and bottom annular surfaces 40, 42 each have a substantially similar area relative to one another.

Furthermore, the downwardly convex drip guide 18 prevents the liquid draining from the inverted first narrow neck container 20 from running between the threaded connection of the device 10 with the neck of the upright second narrow neck container 22 and creating an external mess. The convex shape and continuous uninterrupted configuration of the bottom annular surface 42 in combination with the force of gravity causes the liquid to drain or drip directly downwardly from the lower annular edge 18A of the drip guide 18 into the open neck end 22A of the second container 22. The liquid may be of any viscosity but the device 10 is particularly adapted for use with motor oil and other like liquids which may be harmful to the environment if not removed before disposal of their container. As shown in FIG. 1, the device 10 can have a code or symbol, such as an arrow and the word "top" imprinted on the exterior thereof to indicate to the user which end is the top of the device 10.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A liquid draining device for use between a pair of first and second narrow neck containers, said device comprising:

(a) a body having a pair of opposite top and bottom end portions defining a pair of opposite top and bottom end cavities adapted for receiving respective open neck ends of the first and second narrow neck containers, a middle portion extending between said top and bottom end portions, and a central passageway extending through said middle portion between and open at said top and bottom end cavities and having opposite spaced apart upper and lower end sections and an intermediate section extending between said upper and lower end sections;

(b) an upper funnel substantially concave in shape relative to said top end portion of said body and formed by a continuous uninterrupted top annular surface on said middle portion of said body extending inwardly and downwardly from a bottom of said top end cavity to said upper end section of said central passageway being spaced below said bottom of said top end cavity, said continuous uninterrupted top annular surface intersecting and forming an upper annular edge with said upper end section of said central passageway, said concave shape and continuous uninterrupted configuration of said top annular surface causing a liquid draining from the open neck end of the first narrow neck container disposed in an inverted relation above said bottom of said top end cavity to be received by said upper funnel and drain from said upper annular edge at any location thereabout into said upper end section of said central passageway; and (c) a lower drip guide substantially convex in shape relative to said top end portion of said body and formed by a continuous uninterrupted bottom annular surface on said middle portion of said body extending outwardly and upwardly from said lower end section of said central passageway to a top of said bottom end cavity being spaced above said lower end section of said central passageway, said continuous uninterrupted bottom annular surface intersecting and forming a lower annular edge with said lower end section of said central passageway, said convex shape and continuous uninterrupted configuration of said bottom annular surface causing liquid draining downward through said central passageway to discharge from any location about said lower annular edge of said lower drip guide into the open neck end of the second narrow neck container disposed in an upright relation below said top of said bottom end cavity, said upper annular edge of said upper funnel and lower annular edge of said lower drip guide being vertically spaced from one another at opposite ends of said central passageway.

2. The device of claim 1 wherein said body is substantially cylindrical in shape.

3. The device of claim 1 wherein said top and bottom end cavities each are substantially cylindrical in shape.

4. The device of claim 1 wherein said central passageway is substantially cylindrical in shape.

5. The device of claim 1 wherein said top and bottom end cavities have respective continuous side surfaces with internal threads formed thereon for receiving respective external threads on the open neck ends of the first and second narrow neck containers for securely connecting said device to said containers.

6. A liquid draining device for use between a pair of first and second narrow neck containers, said device comprising:

(a) a body having a pair of opposite top and bottom end portions defining a pair of opposite top and bottom end cavities adapted for receiving respective open neck ends of the first and second narrow neck containers, a middle portion extending between said top and bottom end portions, and a central passageway extending through said middle portion between and open at said top and bottom end cavities and having opposite spaced apart upper and lower end sections and an intermediate section extending between said upper and lower end sections;

(b) an upper funnel formed interiorly of said body by a top annular surface on said middle portion of said body being substantially concave in shape relative to said top end portion of said body and being of continuous uninterrupted configuration, said funnel extending inwardly and downwardly from said top end cavity to said upper end section of said central passageway, said continuous uninterrupted top annular surface intersecting and forming an upper annular edge with said upper end section of said central passageway, said concave shape and continuous uninterrupted configuration of said top annular surface causing a liquid draining from the open neck end of the first narrow neck container disposed in an inverted relation in said top end cavity to be received by said upper funnel and to drain from said upper annular edge at any location thereabout into said upper end section of said central passageway; and (c) a lower drip guide formed interiorly of said body by a bottom annular surface on said middle portion of said body being substantially convex in shape relative to said top end portion of said body and being of continuous uninterrupted configuration, said drip guide extending outwardly and upwardly from said lower end section of said central passageway to said bottom end cavity, said continuous uninterrupted bottom annular surface intersecting and forming a lower annular edge with said lower end section of said central passageway, said convex shape and continuous uninterrupted configuration of said bottom annular surface causing liquid draining downward through said central passageway to discharge from any location about said lower annular edge of said lower drip guide into the open neck end of the second narrow neck container disposed in an upright relation in said bottom end cavity, said upper annular edge of said upper funnel and lower annular edge of said lower drip guide being vertically spaced from one another at opposite ends of said central passageway;

(d) said middle portion of said body having opposite upper and lower faces thereon respectively forming an inner bottom surface of said top end cavity and an inner top surface of said bottom end cavity, said inner bottom and top surfaces being substantially flat and annular in configuration and respectively surrounding said top and bottom annular surfaces forming said upper funnel and lower drip guide, said inner top surface of said bottom end cavity being spaced below and extending substantially parallel to said inner bottom surface of said top end cavity.

7. The device of claim 6 wherein said body is substantially cylindrical in shape.

8. The device of claim 6 wherein said top and bottom end cavities each are substantially cylindrical in shape.

9. The device of claim 6 wherein said central passageway is substantially cylindrical in shape.

10. The device of claim 6 wherein said top and bottom end cavities have respective continuous side surfaces with internal threads formed thereon for receiving respective external threads on the open neck ends of the first and second narrow neck containers for securely connecting said device to said containers.

11. The device of claim 6 wherein said top and bottom annular surfaces each have a substantially similar area relative to one another.

* * * * *